US009822735B2

(12) United States Patent
Odillard et al.

(10) Patent No.: US 9,822,735 B2
(45) Date of Patent: Nov. 21, 2017

(54) DEVICE FOR MIXING A STREAM OF INLET GASES AND OF RECIRCULATED EXHAUST GASES COMPRISING INSULATING MEANS FOR THE RECIRCULATED EXHAUST GASES

(75) Inventors: Laurent Odillard, Le Luart (FR); Sebastien Devedeux, Versailles (FR); Jean-Pierre Galland, Les Essarts-le-roi (FR); Sven Burgold, Rambouillet (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 460 days.

(21) Appl. No.: 13/825,867

(22) PCT Filed: Jul. 28, 2011

(86) PCT No.: PCT/EP2011/063034

§ 371 (c)(1),
(2), (4) Date: Jul. 30, 2013

(87) PCT Pub. No.: WO2012/041563

PCT Pub. Date: Apr. 5, 2012

(65) Prior Publication Data

US 2013/0298884 A1 Nov. 14, 2013

(30) Foreign Application Priority Data

Sep. 27, 2010 (FR) ..... 10 03814

(51) Int. Cl.
*F02M 25/07* (2006.01)
*F02M 35/10* (2006.01)
(Continued)

(52) U.S. Cl.
CPC ..... *F02M 25/0712* (2013.01); *F02M 26/09* (2016.02); *F02M 26/18* (2016.02);
(Continued)

(58) Field of Classification Search
CPC ..... F02M 35/10222; F02M 35/104; F02M 35/1045; F02M 35/108; F02M 25/0704;
(Continued)

(56) References Cited

U.S. PATENT DOCUMENTS 1,539,126 A * 5/1925 Link ..... F02M 26/19 123/545
3,864,908 A * 2/1975 LaHaye ..... 60/272
(Continued)

FOREIGN PATENT DOCUMENTS

DE WO 2010091891 A2 * 8/2010 ..... F01N 5/04
EP 1510684 A2 3/2005
(Continued)

OTHER PUBLICATIONS

English language abstract and machine-assisted English translation for EP 1510684 extracted from the espacenet.com database on Jun. 4, 2013, 15 pages.
(Continued)

*Primary Examiner* — Jacob Amick
*Assistant Examiner* — Michael A Kessler
(74) *Attorney, Agent, or Firm* — Howard & Howard Attorneys PLLC

(57) ABSTRACT

The invention relates to a device for mixing a stream of supercharging air and a stream of recirculated exhaust gases. The device comprises a manifold allowing the stream of air and the stream of recirculated gases to be mixed, and allowing the mixture to be distributed in the cylinder head. The device also comprises means for conveying the recirculated exhaust gases in the manifold that allow the distributed injection of the recirculated exhaust gases into the stream of supercharging air. The device additionally com-
(Continued)

prises means for thermally insulating the conveying means in order to limit the cooling of the recirculated exhaust gases by the supercharging air.

20 Claims, 3 Drawing Sheets

(51) Int. Cl.

| | |
|---|---|
| ***F02M 26/18*** | (2016.01) |
| ***F02M 26/09*** | (2016.01) |
| *F02M 35/108* | (2006.01) |
| *F02M 35/104* | (2006.01) |
| *F02B 29/04* | (2006.01) |
| *F02M 35/112* | (2006.01) |

(52) U.S. Cl.
CPC .. *F02M 35/1045* (2013.01); *F02M 35/10222* (2013.01); *F02B 29/04* (2013.01); *F02M 35/104* (2013.01); *F02M 35/108* (2013.01); *F02M 35/112* (2013.01)

(58) Field of Classification Search
CPC ..... F02M 25/0712; F02M 25/0713; F02M 25/0721; F02M 25/072; F02M 25/0722; F02M 25/0703; F02M 26/00–26/44
USPC ..... 123/568.17, 184.21, 184.35, 123/568.11–568.32; 60/605.2
See application file for complete search history.

(56) References Cited

U.S. PATENT DOCUMENTS

| | | | | | |
|---|---|---|---|---|---|
| 4,106,448 | A * | 8/1978 | Noguchi | F02B 1/06 | 123/198 F |
| 5,121,734 | A * | 6/1992 | Grieshaber | F02B 47/08 | 123/568.17 |
| 5,542,711 | A * | 8/1996 | Vaudry | 285/41 | |
| 5,572,867 | A * | 11/1996 | Bekkering | F01N 3/30 | 60/305 |
| 5,761,905 | A * | 6/1998 | Yamada et al. | 60/322 | |
| 6,003,315 | A * | 12/1999 | Bailey | 60/605.2 | |
| 6,138,649 | A * | 10/2000 | Khair | F01N 3/031 | 123/559.2 |
| 6,267,106 | B1 * | 7/2001 | Feucht | F02M 26/19 | 123/568.17 |
| 6,422,221 | B2 * | 7/2002 | Pietrowski et al. | 123/568.17 | |
| 6,427,671 | B1 * | 8/2002 | Holze | B01F 5/045 | 123/568.17 |
| 6,966,310 | B2 * | 11/2005 | Moren | F01M 13/022 | 123/184.54 |
| 7,032,579 | B2 * | 4/2006 | Nishida | F02M 35/10085 | 123/568.17 |
| 7,247,067 | B2 * | 7/2007 | Mashiko | 440/88 A | |
| 8,919,121 | B2 * | 12/2014 | Schlemmer-Kelling | F01N 5/04 | 123/184.21 |
| 2006/0124116 | A1 * | 6/2006 | Bui | F02B 37/013 | 123/568.18 |
| 2010/0154759 | A1 * | 6/2010 | Taira | F02M 13/00 | 123/568.17 |
| 2014/0150757 | A1 * | 6/2014 | Drangel | F02M 25/07 | 123/568.11 |

FOREIGN PATENT DOCUMENTS

| | | | |
|---|---|---|---|
| EP | 1522714 | A2 | 4/2005 |
| EP | 2014906 | A1 | 1/2009 |
| JP | 2001-123901 | A | 5/2001 |

OTHER PUBLICATIONS

English language abstract and machine-assisted English translation for JP 2001-123901 extracted from the PAJ database on Jun. 4, 2013, 33 pages.
International Search Report for Application No. PCT/EP2011/063034 dated Nov. 9, 2011, 6 pages.

* cited by examiner

DEVICE FOR MIXING A STREAM OF INLET GASES AND OF RECIRCULATED EXHAUST GASES COMPRISING INSULATING MEANS FOR THE RECIRCULATED EXHAUST GASES

RELATED APPLICATIONS

This application is the National Stage of International Patent Application No. PCT/EP2011/063034, filed on Jul. 28, 2011, which claims priority to and all the advantages of French Patent Application No. FR 10/03814, filed on Sep. 27, 2010, the content of which is incorporated herein by reference.

The invention relates to the general field of supplying air to motor vehicle engines, and more particularly engines of which the supply air comes from a compressor or a turbocompressor.

A motor vehicle combustion engine comprises a combustion chamber, generally formed by a plurality of cylinders, in which a mixture of oxidant and fuel is burned in order to generate engine work. The gases admitted into the combustion chamber are termed intake gases. They contain air, which is named supercharging air when it comes from a compressor.

In order to increase the density of the supercharging air, these gases are generally cooled before being introduced into the combustion chamber; this function is performed by a heat exchanger, also called a charged air cooler ("CAC").

A charged air cooler which can be used in the context of the invention comprises at least one heat exchange bundle. This heat exchange bundle may comprise parallel tubes or a stack of plates alternately forming circulation ducts for the supercharged air to be cooled and ducts for the circulation of the engine coolant. The heat exchange between the tubes or the plates and the supercharging air is carried out partly via turbulators. This exchanger can have the particular feature of being integrated into the intake manifold of the internal combustion engine.

In order to reduce polluting emissions, it is known practice to introduce into the stream of intake gases what are called "recirculated" exhaust gases, in a process known as exhaust gas recirculation ("EGR"). These are exhaust gases withdrawn downstream of the combustion chamber so as to be reconveyed (recirculated) toward the stream of intake gases, upstream of the combustion chamber, where they are mixed with the supercharging air with the aim of being admitted into the combustion chamber. Conventionally, the recirculated exhaust gases are introduced via one or more injection points formed in a gas intake pipe extending between the cooler of the intake gases and the engine, in order that the recirculated exhaust gases mix with the gases coming from the cooler.

At the present time, it is aimed to bring the heat exchanger as close as possible to the engine in order to achieve greater compactness.

When the distance between the charged air cooler and the inlet of the intake ducts is too small to ensure a homogeneous mixture between the gases of the CAC and the EGR gases, the latter are introduced into the intake manifold via a duct which extends transversely to the flow of the supercharging air and which opens out downstream of the CAC by a succession of holes. The duct is swept by the cold supercharging air stream.

The spread of the cylinder-to-cylinder temperature may then be very large when the EGR gases are cooled heterogeneously by the air coming from the CAC. This is particularly the case at the duct since the gas which passes through the whole duct before injection is more cooled than the gas which is injected starting from the first injection hole. That complicates the management of the internal combustion engine and makes it more difficult, or even impossible, to control the combustion for each cylinder.

The invention aims to provide a device of this type in which the intake gases, leaving the device, have a more homogeneous temperature at the inlet into the various cylinders of the cylinder head.

Accordingly, the invention relates to a device for mixing a stream of supercharging air and a stream of recirculated exhaust gases with a view to admitting them into the cylinder head of a motor vehicle combustion engine, comprising:

- a manifold allowing the stream of supercharging air (4) and the stream of recirculated exhaust gases to be mixed, and allowing the mixture to be distributed in the cylinder head,
- means for conveying recirculated exhaust gases in said manifold (8) that allow the distributed injection of the recirculated exhaust gases into the stream of supercharging air, characterized in that said device additionally comprises means for thermally insulating the conveying means in order to limit the cooling of the recirculated exhaust gases by the supercharging air.

Thus, heat exchange between the recirculated exhaust gases and the supercharging air is minimized so as to promote the injection of the exhaust gases at a uniform temperature and hence to homogenize the temperature of the intake gases formed by the mixture of the supercharging air and the recirculated exhaust gases.

The device according to the invention therefore makes it possible to obtain a mixture of gases admitted into the cylinder head of the engine having a homogeneous temperature in spite of the positioning of the tube for injecting the exhaust gases along the path of the cooled supercharging air. In other words, it makes it possible to combine compactness, efficiency and performance. Additionally, the device can be mounted in a simple and rapid manner.

According to particularly simple and convenient implementation features, both in terms of manufacture and use:

- the conveying means have a thermal conductivity of less than or equal to 50 $W \cdot m^{-1} \cdot K^{-1}$, or even less than or equal to 30 $W \cdot m^{-1} \cdot K^{-1}$;
- the thermal insulation means comprise a supercharging air deflector placed upstream of said conveying means in the direction of circulation of the supercharging air, said deflector diverting the stream of supercharging air so that it bypasses the conveying means;
- the deflector is in one piece with the manifold;
- the conveying means are arranged in a housing of which the upstream face in the direction of circulation of the supercharging air forms the deflector;
- the conveying means comprise a tube inside which the recirculated exhaust gases circulate and which extends transversely to the direction of circulation of the supercharging air;
- the tube and the manifold comprise reciprocal mechanical fastening means;
- the manifold is overmolded on the tube;
- the tube comprises a series of holes distributed over its length;
- the tube comprises a single wall made of steel, optionally stainless steel;
- the tube comprises a double wall made of aluminum;

the tube comprises a double wall made of stainless steel;

the device additionally comprises a heat exchanger comprising a heat exchange bundle for cooling the supercharging air.

The features and advantages of the invention will become apparent from the description which follows, given by way of preferred but non-limiting example, with reference to the appended drawings, in which.

Figure 1:
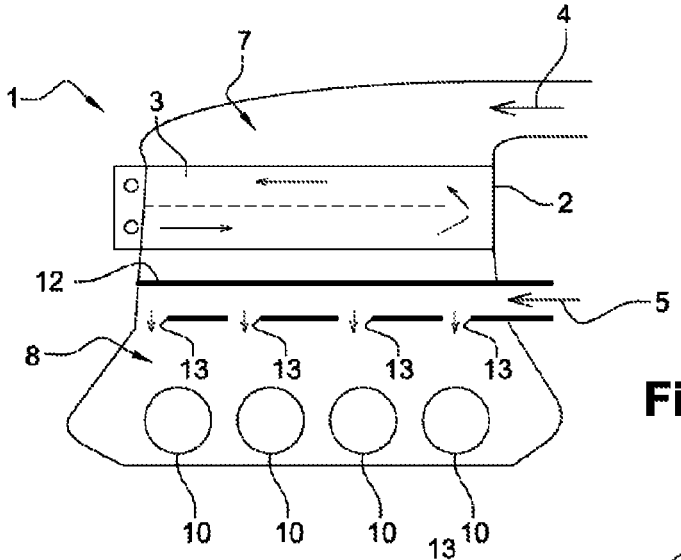
FIG. 1 is a schematic view of a device according to a first embodiment of the invention.

With reference to FIG. 1, a device 1 for mixing gases in the cylinder head of a motor vehicle combustion engine (not shown) comprises a heat exchanger 2 comprising a heat exchange bundle 3 designed to exchange heat with a first stream of gases, here the supercharging air 4 from the compressor (not shown). The exchanger 2 here is a charged air cooler (CAC).

In the text which follows, the terms "upstream" and "downstream" are defined with respect to the direction of circulation of the supercharging air in the mixing device 1, the supercharging air 4 and then the mixture of supercharging air 4/recirculated exhaust gases 5 ("EGR") circulating from upstream to downstream in the device 1.

The supercharging air is introduced into the heat exchanger 2 through an inlet manifold 7, mounted upstream of the heat exchanger 2, and discharged through a manifold 8, also called the distribution manifold, mounted downstream of the heat exchanger 2 and intended to be connected to the cylinder head (not shown) of the engine.

The distribution manifold 8 is made of metal and is mounted on the cylinder head of the engine. The distribution manifold 8 allows a distributed intake, into the cylinder head, of the intake gases formed of the mixture of the supercharging air and the recirculated exhaust gases.

The distribution manifold 8, mounted downstream of the heat exchanger 2, comprises an upstream part with an upstream face, onto which the outlet face of the bundle 3 opens, and a downstream part intended to be fastened to the cylinder head of the engine. The downstream part of the manifold 8 here comprises outlet ducts 10 designed to open respectively into the intake cylinders of the engine. Thus, the supercharging air taken in by the upstream face of the manifold 8 is distributed in the outlet ducts in order to supply the cylinders of the engine with gases for the combustion thereof.

The manifold 8 is substantially flared from upstream to downstream.

The mixing device 1 additionally comprises means for injecting the EGR gases 5. The injection means comprise a cylindrical tube 12. The injection tube 12 here comprises an inlet orifice 14 for letting the recirculated exhaust gases 5 into the tube 12. The tube 12 extends opposite the outlet of the exchanger 2, transversely to the direction of circulation of the supercharging air 4. The tube 12 here extends over the whole width of the manifold 8. It has on its downstream side a series of four injection holes 13. These holes allow the injection of the EGR gases 5 into the stream of supercharging air 4, the injection being distributed by virtue of the distribution of the holes 13 along the tube 12.

That allows the two gases 4, 5 to be mixed starting from a plurality of injection holes, the concentration of the recirculated exhaust gases then being able to be substantially homogenized at any point of the mixing. At the confluence zone of the two streams of gases 4, 5, turbulence is created, thus promoting the homogenization of said mixture. The mixture of gases 4, 5 admitted into the cylinders of the engine is thus more homogenous and performance of the engine, in terms of combustion, is improved.

It goes without saying that the injection pipe could comprise two injection orifices intended to allow the simultaneous or alternate introduction of two streams of recirculated exhaust gases of different or identical types. In this case, the streams of recirculated exhaust gases may or may not be cooled, at a high pressure or low pressure. An injection of recirculated exhaust gases of different types makes it possible to modify the type of the oxidant in the cylinders of the engine and thus to modify the performance of the engine during its operation at low load or high load.

According to variant embodiments which are not shown, the manifold has a number of holes or a shape or dimensions of the hole which are different. A different distribution of the holes on the surface of the tube can be provided. According to other variants, the injection means are formed of a longitudinal slot.

As the tube 12 is positioned across the stream of supercharging air 4 cooled by its passage in the exchanger 2, in the absence of any precaution, the recirculated exhaust gases 5 can be cooled. Owing to the geometry of the tube with respect to the direction of circulation of the supercharging air, the more the exhaust gases travel a path inside the tube, the longer they are in contact with the wall of the tube.

In order to avoid them exchanging heat with the supercharging air, means for insulating the tube 12 are provided. In this embodiment, it is the tube 12 itself which performs the function of insulation means by virtue of its structure or by virtue of the choice of the material from which it is formed.

Figure 2:
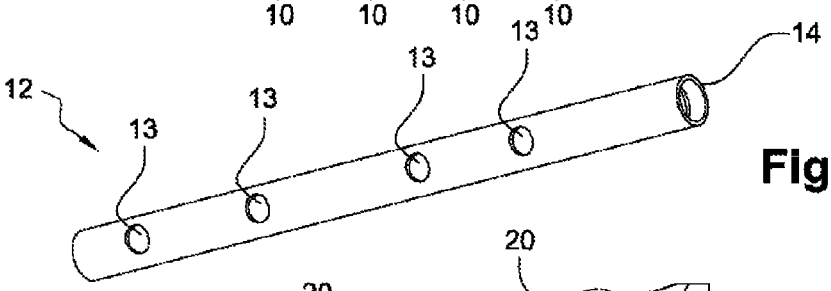
FIG. 2 is a perspective view of the tube for conveying the recirculated exhaust gases of the device of FIG. 1.

The tube 12 represented in FIG. 2 comprises a single wall made of stainless steel whose thermal conductivity is 26 $W \cdot m^{-1} \cdot K^{-1}$. That makes it possible to limit the heat exchange between the two stream of gases and to inject the EGR gases at the same temperature whatever the distance from the injection hole 13 to the inlet 14 in comparison for example with a single wall made of aluminum whose thermal conductivity is 200 $W \cdot m^{-1} \cdot K^{-1}$. The values given here are approximate values which depend in particular on the exact combination of the materials used.

As a variant, it is possible to use steel whose thermal conductivity is 46 $W \cdot m^{-1} \cdot K^{-1}$. To a certain degree, depending on the expected results, it is also possible to consider iron (80 $W \cdot m^{-1} \cdot K^{-1}$) or even cast iron (100 $W \cdot m^{-1} \cdot K^{-1}$).

According to another variant, the wall of the tube 12 has a double wall in which the structure made up of the two layers separated by an air layer makes it possible to significantly lower the thermal conductivity. It is possible to choose for this purpose a double wall made of aluminum whose thermal conductivity, which for a single layer is 200 $W \cdot m^{-1} \cdot K^{-1}$, is considerably lowered in this double-layer use. Alternatively, use may be made of cast iron, iron, steel and in particular stainless steel. Among all these materials, it is the tube with a double wall made of stainless steel which has the lowest thermal conductivity for a very good insulation of the EGR gases.

Of interest now is the travel of the gases. A portion of the supercharging air 4, when it leaves the exchanger 2, comes against the tube 12 and then continues its travel downstream of the tube 12. Downstream of the tube, the supercharging air 4 mixes with the EGR gases, the low conductivity of the tube having prevented a heterogeneous cooling. The mixture of gases 4, 5 finally arrives at the outlet ducts 10, having a more homogeneous temperature.

Since the mounting of the manifold 8 is well known and does not form the subject of the invention, it will not be described here. It will simply be noted that the tube 12 can be mounted mechanically on the manifold by providing the necessary reciprocal fastening means. Provision can otherwise be made to overmold the manifold on the tube.

With reference to FIGS. 3 to 7, a second embodiment will now be described in which the tube 12 is arranged in a casing 15. For the identical or similar elements, the same references will be kept as for the description of the embodiment corresponding to FIGS. 1 and 2. The manifold 8 is oriented in FIGS. 3 to 7 such that the stream of supercharging air circulates from right to left, the face that can be seen in the figures corresponding to the upstream end of the tube 12.

The manifold has two opposed walls 17, 18 between which the stream of supercharging air circulates. The manifold 8 has a casing 15 in which the tube 12 is arranged. The casing 15 is in one piece with the first wall 17 of the manifold 8. The casing 15 extends transversely to the stream of supercharging air. Also starting from this wall 17 are the fastening means 20 which make it possible to fasten together the manifold 8 and the cylinder head (not shown) of the engine. These fastening means are well known and will not be described in more detail here.

Upstream of the tube 12 and starting from the wall 17, there extends a deflector 21, forming the insulating means, which protects the tube 12 from the supercharging air and which diverts this air from the tube 12. The deflector 21 is formed by the upstream face of the casing 15. The deflector 21 extends like the tube 12 over the whole width of the manifold 8.

The deflector 21 has a shield 22 of rectangular and planar shape extending away from the tube 12 such that the shield 22 shelters the tube 12 from the stream of the supercharging air gas.

In the direction of the second wall 18, the deflector 21 is extended over its whole length by a bent surface 24 such that the deflector 21 is wound at a distance around the face of the tube 12 that is exposed to the stream of supercharging air.

On the downstream side of the tube 12, the tube 12 is free of the deflector 21 and has its holes 13 for injecting the EGR gases.

A portion of the supercharging air 4, when it leaves the exchanger 2, strikes against the shield 22 of the deflector 21, bypasses it against the bent surface 24 and then continues its travel downstream of the tube 12. Downstream of the tube, the supercharging air 4 mixes with the EGR gases, the presence of the deflector having prevented a heterogeneous cooling. The mixture of gases 4, 5 finally arrives at the outlet ducts 10, having a more homogeneous temperature than in the absence of the deflector 21.

Between the opposed walls 17, 18, there extend struts 25 which help to stiffen the manifold 8. They have an aerodynamic shape in order to limit their influence on the flow of the supercharging air.

Figure 6:
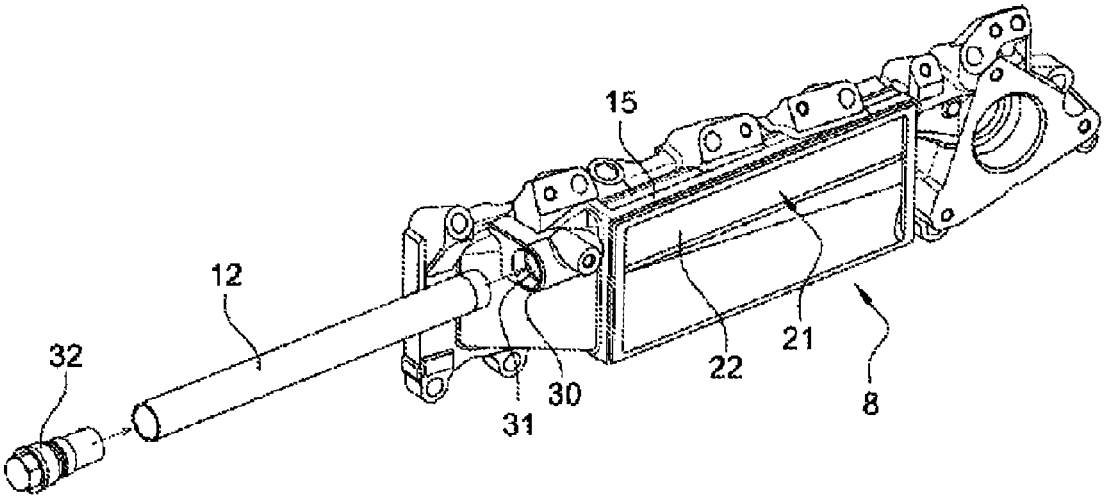
FIG. 6 is an exploded perspective view of a variant embodiment of the manifold according to the second embodiment.
Figure 7:
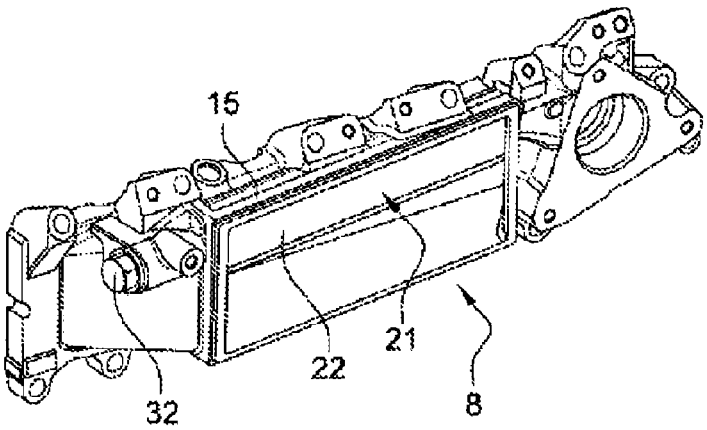
FIG. 7 is a similar view to that of FIG. 6, the tube being mounted in the manifold.

In the variant embodiment represented in FIGS. 6 and 7, the manifold 8 does not have any struts.

According to a variant embodiment which is not shown, the deflector is attached to the manifold in such a way that it is possible to choose the material from which the deflector is formed, for example steel.

The manufacture of such a manifold will now be described.

Figure 3:
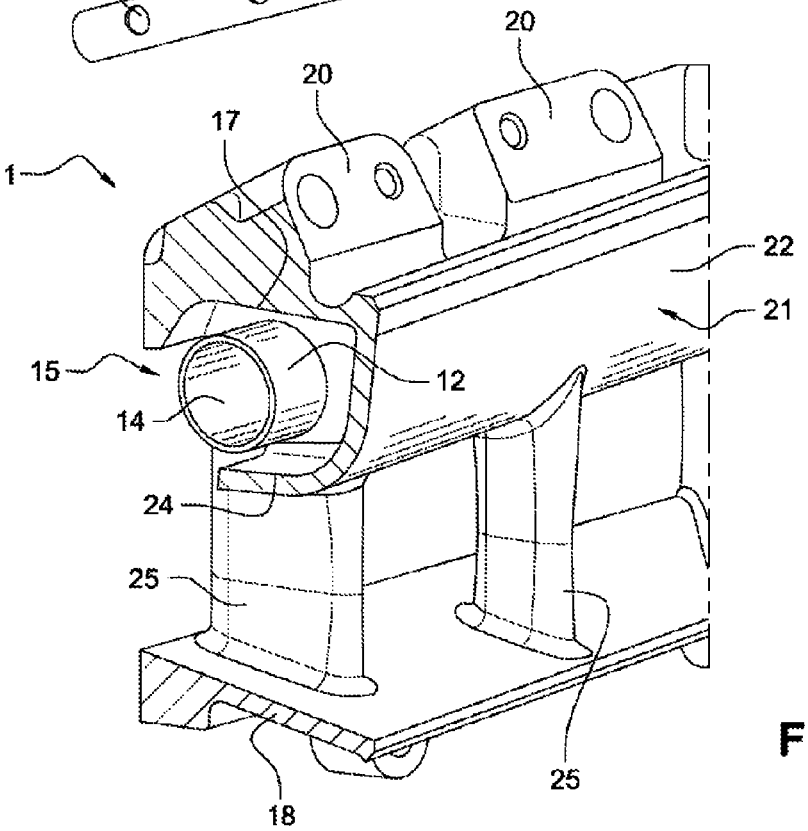
FIG. 3 is a perspective view in section of a device according to a second embodiment of the invention.
Figure 4:
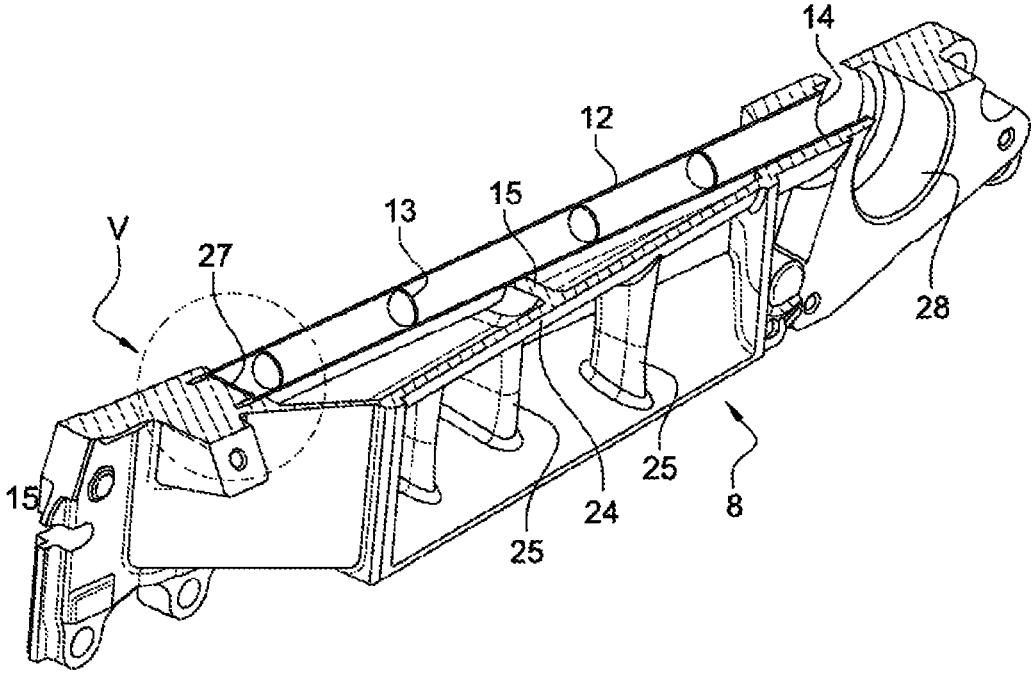
FIG. 4 is a perspective view in section taken along the axis of the tube of the manifold of FIG. 3.
Figure 5:
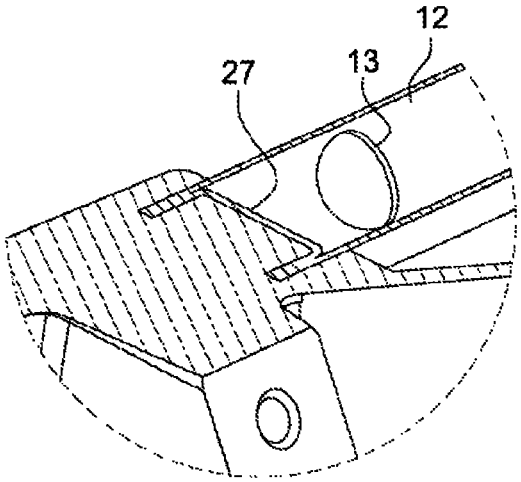
FIG. 5 is a detail view indicated by V in FIG. 4.

With reference to FIGS. 3 to 5, the device comprises a manifold 8 overmolded on the tube 12. The tube 12 is first of all procured or formed. The tube is capped at its ends by cylindrical plugs 27. In a suitable mold, the tube 12 is placed and the metal is injected to form the manifold 8. Then, the tube 12 is pierced with injection holes 13 and the manifold is machined to form a completely cylindrical opening 28 in order to connect the tube 12 to a valve (not shown) for distributing the recirculated exhaust gases in the tube 12. According to a variant, the tube 12 is pierced prior to the molding and masks are provided on the mold or on the tube to prevent the metal from penetrating the tube 12.

With reference to FIGS. 6 and 7, the device comprises a tube 12 mounted mechanically in the casing 15 of the manifold 8. For this purpose, the manifold 8 is molded while providing a passage 30 for insertion of the tube 12 in the casing 15 and while providing fastening means 31 on the passage 30. The fastening means 31 are of the tapped hole type which mate with a fastening screw 32.

Then, the tube 12 pierced with holes is inserted into the casing 15 through the passage 30 and then the screw 32 is screwed to the fastening means 31.

According to a variant of the embodiments described above, provision can be made to combine the various embodiments; for example, provision can be made to provide a double-walled tube made of stainless steel in a casing fitted with a deflector.

The present invention is not limited to the embodiments described and represented but encompasses any variant embodiment. In particular, provision may be made, for the tube and/or the deflector, to form them in materials having suitable properties both in terms of strength and thermal conductivity.

The invention claimed is:

1. A device for mixing a stream of supercharging air and a stream of recirculated exhaust gases with a view to admitting them into a cylinder head of a motor vehicle combustion engine, said device comprising:

a distribution manifold allowing the stream of supercharging air and the stream of recirculated exhaust gases to be mixed, and allowing the mixture to be distributed in the cylinder head, said distribution manifold having a pair of opposing walls between which the stream of supercharging air circulates and including a casing in one piece with a first wall of said pair of opposing walls, said casing extending transversely to the stream of the supercharging air;

means for conveying recirculated exhaust gases in said distribution manifold that allow the distributed injection of the recirculated exhaust gases into the stream of supercharging air, wherein said device additionally comprises means for thermally insulating said means for conveying in order to limit the cooling of the recirculated exhaust gases by the supercharging air; and wherein said means for thermally insulating comprises a supercharging air deflector for diverting the stream of supercharging air so that it bypasses said means for conveying, and said means for conveying is arranged in said casing of which at least a portion forms said supercharging air deflector, wherein said supercharging air deflector extends over an entire width of said distribution manifold and wherein said supercharging air deflector has an 'L' shaped cross-section which extends along an entire length of said supercharging air deflector in the direction of its longitudinal axis along said means for conveying.

2. The device as claimed in claim 1, wherein said means for conveying has a thermal conductivity of less than or equal to 50 $W \cdot m^{-1} \cdot K^{-1}$.

3. The device as claimed in claim 2, wherein said means for conveying has a thermal conductivity of less than or equal to 30 $W \cdot m^{-1} \cdot K^{-1}$.

4. The device as claimed in claim 1, wherein said supercharging air deflector is placed upstream of said means for conveying in the direction of circulation of the supercharging air.

5. The device as claimed in claim 4, wherein said deflector is in one piece with said distribution manifold.

6. The device as claimed in claim 4, wherein said means for conveying is arranged in said casing of which the upstream face in the direction of circulation of the supercharging air forms said supercharging air deflector.

7. The device as claimed in claim 1, wherein said means for conveying comprises a tube inside which the recirculated exhaust gases circulate and which extends transversely to the direction of circulation of the supercharging air.

8. The device as claimed in claim 7, wherein said tube and said distribution manifold comprise reciprocal mechanical fastening means.

9. The device as claimed in claim 7, said distribution manifold is overmolded on said tube.

10. The device as claimed in claim 7, wherein said tube comprises a series of holes distributed over its length.

11. The device as claim 1, wherein said means for conveying comprises a tube inside which the recirculated exhaust gases circulate, said tube comprising a single wall made of steel.

12. The device as claimed in claim 11, wherein said tube comprises a single wall made of stainless steel.

13. The device as claimed in claim 1, wherein said means for conveying comprises a tube inside which the recirculated exhaust gases circulate, said tube comprising a double wall made of aluminum.

14. The device as claimed in claim 1, wherein said means for conveying comprises a tube inside which the recirculated exhaust gases circulate, said tube comprising a double wall made of stainless steel.

15. The device as claimed in claim 1, further comprising a heat exchanger comprising a heat exchange bundle for cooling the supercharging air.

16. The device as claimed in claim 2, wherein said thermal insulation means comprise said supercharging air deflector placed upstream of said means for conveying in the direction of circulation of the supercharging air, said deflector diverting the stream of supercharging air so that it bypasses said means for conveying.

17. The device as claimed in claim 1, wherein said means for conveying comprises a tube which includes a series of injection holes for allowing the injection of recirculated exhaust gases into the stream of supercharged air.

18. The device as claimed in claim 17, wherein said tube extends over said entire width of said manifold.

19. The device as claimed in claim 17, said supercharging air deflector comprises a shield of rectangular and planar shape which extends away from said tube such that said shield shelters said tube from the stream of supercharged air.

20. The device as claimed in claim 17, wherein said supercharging air deflector comprises a bent surface such that said supercharging air deflector bends around a circumference of said tube.

* * * * *